United States Patent [19]

Miller et al.

[11] 4,353,314

[45] Oct. 12, 1982

[54] BOX CAR CORNER POST ARRANGEMENT

[75] Inventors: Roy W. Miller, Highland, Ind.; Bhaskara R. Mutyala, Birmingham, Ala.

[73] Assignee: Pullman Incorporated, Chicago, Ill.

[21] Appl. No.: 180,262

[22] Filed: Aug. 22, 1980

[51] Int. Cl.[3] ..... B61D 17/06

[52] U.S. Cl. ..... 105/410; 105/404; 296/29

[58] Field of Search ..... 105/396, 402–404, 105/409, 410, 421, 423; 296/29, 30; 52/105, 282, 735; 220/1.5

[56] References Cited

U.S. PATENT DOCUMENTS

| | | | |
|---|---|---|---|
| 1,410,710 | 3/1922 | Murphy | 105/410 |
| 1,639,264 | 8/1927 | McMullen | 105/410 |
| 1,734,247 | 11/1929 | Eklind et al. | 105/410 |
| 2,207,955 | 7/1940 | Thompson | 105/410 |
| 2,460,982 | 2/1949 | Gilpin | 105/404 |
| 3,536,345 | 10/1970 | Leifer | 52/735 |
| 3,557,715 | 1/1971 | Johansson | 105/409 |
| 3,750,352 | 8/1973 | Jones | 105/410 X |
| 3,774,552 | 11/1973 | Snyder et al. | 105/409 X |
| 3,866,546 | 2/1975 | Malo | 105/410 |

*Primary Examiner*—Randolph A. Reese
*Attorney, Agent, or Firm*—Richard J. Myers

[57] ABSTRACT

The subject invention relates to the corner construction of a railway car, wherein the end wall, vertical reinforcing plate, side wall corner post and side plate are arranged with associated parts in a manner permitting an assembly without rotation of the car during manufacture.

4 Claims, 6 Drawing Figures

BOX CAR CORNER POST ARRANGEMENT

BACKGROUND OF THE INVENTION

1. Field of the Invention

The present invention pertains to the field of railway car body design and particularly to a simplified end corner construction.

2. Description of the Prior Art

Heretofore, various attempts have been made to provide a construction for a railway freight car body end wall, and particularly the corner post thereof, which is easily fabricated and assembled while still providing the necessary strength and durability for this highly stressed portion of the car body.

Jones U.S. Pat. No. 3,750,352 discloses a channel shaped vertical corner post having longitudinally extending flanges to which the side sheathing of the car body is connected. Thompson U.S. Pat. No. 2,207,955 discloses a car end construction which comprises reversely channeled plates and spaced apart corner posts. Malo U.S. Pat. No. 3,866,546 discloses a box car end with an offset portion being integrally affixed to the end sill vertical extension. Eklind et al U.S. Pat. No. 1,734,247 discloses a corrugated car end and a pair of corner posts, each embodying a Z bar. Gilpin U.S. Pat. No. 2,460,982 discloses a structural member adapted for use as a railway car side plate, side sill or corner post comprising an extended hollow metallic section, whereby a box structural member is provided. Murphy U.S. Pat. No. 1,410,710, discloses a metal end structure for railway cars. Johansson U.S. Pat. No. 3,557,715 discloses a railroad car end corner construction connecting the lower end of the side wall to the end wall of the car and it is specifically directed to a construction employing aluminum. McMullen U.S. Pat. No. 1,639,264 discloses the wall structure for railway cars.

None of the above mentioned patents reflect the inventive concept disclosed in the subject invention which provides a simplified end corner construction which facilitates fabrication and assembly while providing the necessary rigidity.

SUMMARY OF THE INVENTION

The primary object of the present invention is to provide a simplified and easily assembled corner construction for the body ends of a railway box car. The invention resides in a corner assembly comprising a side wall corner post which includes a vertically extending terminal flange. A vertically extending reinforcing plate is assembled in abutment with the end wall, the reinforcing plate being then mechanically fastened to the corner post. Stop tabs punched out of the corner post facilitate a fast and proper alignment of the reinforcing plate with the corner portion. Also, these tabs prevent an excessive outward movement of the reinforcing plate during the corner construction assembly. A channel-shaped side plate running along the top of and connected with the side wall is further connected to the reinforcing plate.

These elements of the corner structure make it possible to build a sturdy construction without rotation of the car body, which is normally required for the welding in a down hand position of a side sheet to a steel end having a box corner post. The end and side walls may be connected to each other in an upright position by any conventional mechanical fastening means.

DESCRIPTION OF THE PREFERRED EMBODIMENT

Figure 1:
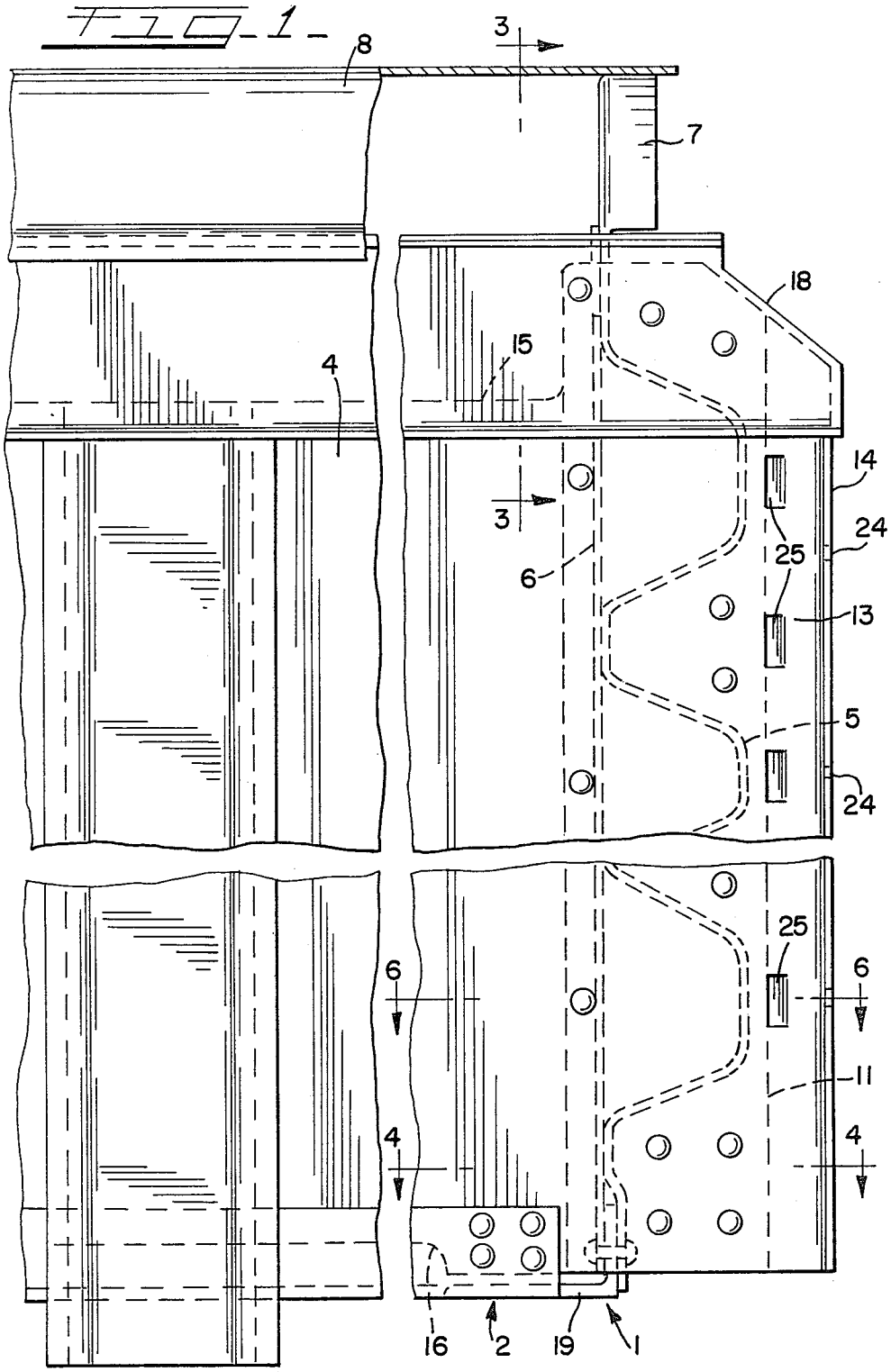
FIG. 1 is a side elevational view of an end portion of a railway car body.
Figure 2:
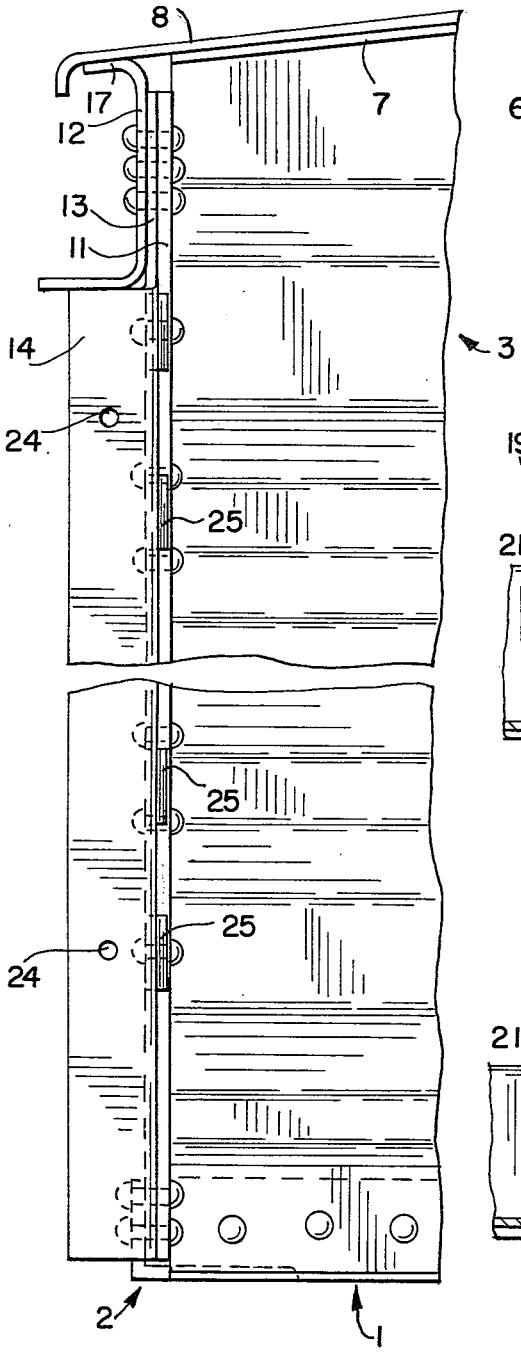
FIG. 2 is an end view of a railway box car body.
Figure 5:
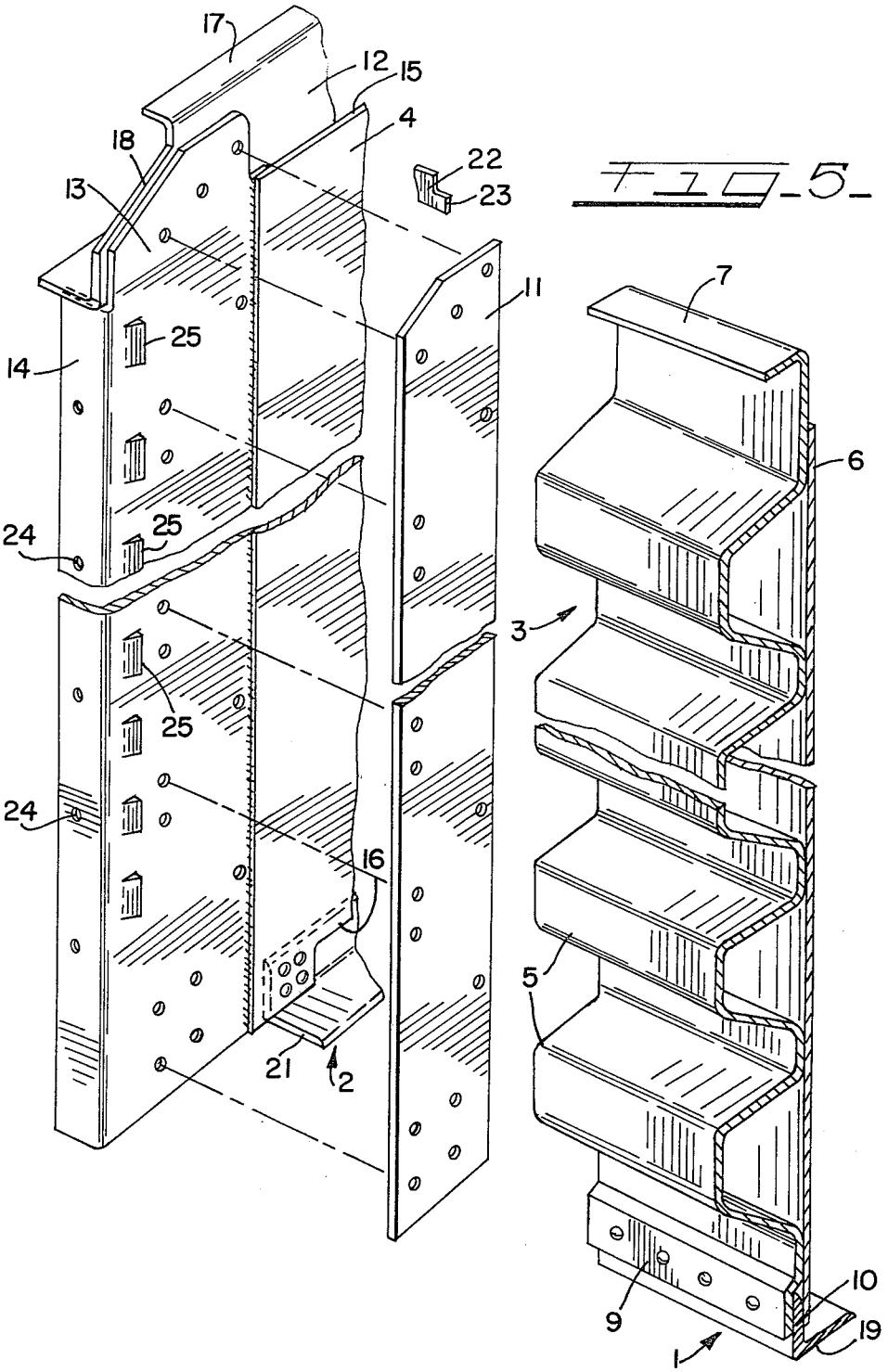
FIG. 5 is an exploded perspective view of a corner construction of a railway box car.

As best shown in FIGS. 1, 2 and 5, each of the corners of a railway car body comprises an underframe including end sill 1 and side sill 2, end wall 3 and side wall 4.

Figure 3:
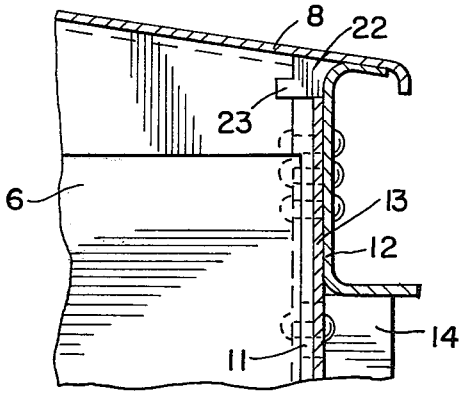
FIG. 3 is a cross sectional view taken substantially along the line 3—3 of FIG. 1.
Figure 4:
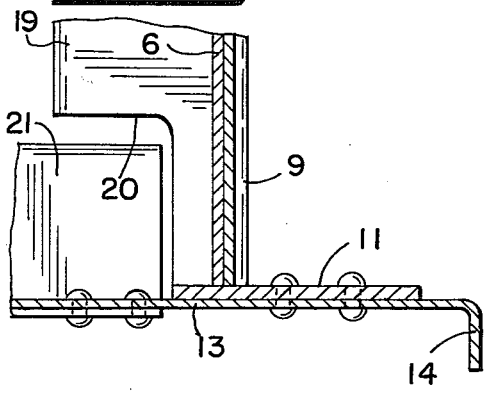
FIG. 4 is a cross sectional view taken substantially along line 4—4 of FIG. 1.
Figure 6:
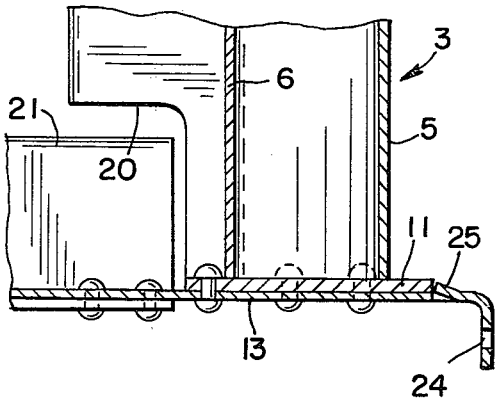
FIG. 6 is a cross sectional view taken substantially along line 6—6 of FIG. 1.

The end wall 3 comprises a plurality of vertically spaced and horizontally extending corrugations forming a sheathing 5, and a vertical end sheet or end lining 6 permanently attached thereto. The upper flange 7 extending perpendicularly outwardly from the sheathing 5 is attached to a sloping roof sheet 8. The bottom flattened end portion of the sheathing 5 forms a vertical flange 9 outwardly offset from the end lining 6, thereby accommodating a vertical flange 10 of the end sill 1. The bottom sheathing flange 9, vertical flange 10 of the end sill 1 and the bottom portion of the end lining 6 are contiguously secured to each other by any mechanical connecting means. The side portion of the sheathing 5 is abutted and secured to a vertical reinforcing plate 11 contiguous with a side plate 12 and corner post 13. As best shown in FIGS. 4, 5 and 6, the corner post 13, which may be either integral with or welded to side wall 4, extends longitudinally outwardly from the end lining 6. A vertical terminal flange 14 extends laterally outwardly from the side wall 4. The side wall 4 has the recessed upper 15 and lower 16 portions intermediate of the corner posts 13. A channel-shaped plate 12 extends longitudinally along the top of the side wall and has and upper flange 17 attached to the roof sheet 8. The side plate 12, the corner post 13 and the reinforcing plate 11, which are attached to each other in sandwich-like relation, each have a truncated upper corner 18. As best shown in FIG. 4, the horizontal flange 19 of the end sill has a right angle cut out at the inner corner 20 thereby providing assembly space for the side sill horizontal flange 21. As shown in FIG. 3, the sheet metal hole filler 22 covers the opening in the upper corner of the end wall defined by the roof sheet 8, side plate 12, sheathing 5, top edge of the side wall corner portion 13 and reinforcing plate 11. The filler has a rectangular protrusion 23 for attachment purposes. As shown in FIG. 6, the corner post 13 has vertically spaced apertures 24 for ladder grabs. Stop tabs 25, punched out of the corner portion 13, serve to facilitate quick and accurate alignment of the reinforcing plate 11 with the corner post 13 and also to limit an outward movement of the corrugated end wall 3 when the car is impacted.

The present construction easily lends itself to assembly, when the car is in an upright position, utilizing huck bolts, rivets, bolts and nuts or similar fastening means. Therefore, the need to reposition the car body on its respective side during assembly in order to weld the end wall to the side wall in a down hand position, as is necessary in assembling a car body employing a box corner post construction, is eliminated. Further, the inclusion of stop tabs in corner post provides self-alignment of the corrugated end wall relative to the side wall assembly as they size the inside length of the box car assembly, further contributing to simplification of assembly. Consequently, saving in assembly time may be achieved. Another important function of the tabs is to provide the shearing resistance in the corner assembly to the impact force generated by an outward movement of the lading constrained by the end wall.

What is claimed is:

1. In a railway car having an end wall having a finite thickness and a side wall, a car corner construction comprising:

a corner post with means attached to an forming a continuation of said side wall;

a flat, vertically disposed reinforcing plate extending across the thickness of the end wall and sandwiched and affixed between the end wall and said corner post, and, said reinforcing plate having a first vertical edge;

means securely attaching the reinforcing plate to both the corner post and the end wall to provide a secure connection;

a side plate connected to the upper position of the side wall and further having end means connected to said reinforcing plate to thereby rigidly interconnect the side plate with the end wall;

said corner post having integrally formed means for alignment of the reinforcing plate and said integrally formed means being disposed adjacent said first vertical edge of the reinforcing plate to provide stop means to limit outward movement of said end wall.

2. A railway car corner construction in accordance with claim 1, and said means for alignment including:

stop tabs integrally formed into said corner post and extending outwardly from said corner post and abutting said first vertical edge of the reinforcing plate.

3. A railway car corner construction in accordance with claim 1, and:

said end wall having a corrugated sheath with an end lining attached thereto;

weld means joining the reinforcing plate to both the corrugated sheath and end lining.

4. A railway car corner construction in accordance with claim 3, and:

mechanical fasteners extending through both said reinforcing plate and said corner post and securely joining the end wall to the side wall.

* * * * *